US007701359B2

(12) United States Patent
Hatemata

(10) Patent No.: US 7,701,359 B2
(45) Date of Patent: Apr. 20, 2010

(54) SETTING DEVICE OF CONTROL SYSTEM

(75) Inventor: Takeshi Hatemata, Kadoma (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 1242 days.

(21) Appl. No.: 11/230,515

(22) Filed: Sep. 21, 2005

(65) Prior Publication Data

US 2006/0066151 A1 Mar. 30, 2006

(30) Foreign Application Priority Data

Sep. 22, 2004 (JP) ..... 2004-275423

(51) Int. Cl.
*G08C 19/00* (2006.01)

(52) U.S. Cl. ..... 340/825.72; 340/825.22; 340/310.16; 340/538.15; 340/3.1; 340/307; 340/539.16; 340/286.02

(58) Field of Classification Search ..... 340/825.72, 340/825.22, 310.16, 538.15, 539.16, 307; 700/9, 19

See application file for complete search history.

(56) References Cited

U.S. PATENT DOCUMENTS 6,459,938 B1 * 10/2002 Ito et al. ..... 700/9

6,583,719 B2 * 6/2003 Okada et al. ..... 700/17

FOREIGN PATENT DOCUMENTS

JP 4-233895 8/1992
JP 2000-115865 4/2000

OTHER PUBLICATIONS

English Language Abstract of JP 2000-115865.
English Language Abstract of JP 4-233895.
U.S. Appl. No. 11/157,960 to Hatemata, filed Jun. 22, 2005.
U.S. Appl. No. 11/186,881 to Kawamata, filed Jul. 22, 2005.

* cited by examiner

*Primary Examiner*—Vernal U Brown
(74) *Attorney, Agent, or Firm*—Greenblum & Bernstein P.L.C.

(57) ABSTRACT

A setting device used in an illumination control system to realize a separate control, a group control, and a pattern control is disclosed. The object of the present invention is to enable a setting operation to be performed easily, and to prevent missing. In connection with the switch arranged on a wall side, the setting device sets a separate address of the separate control, a group number of the group control, and a pattern number of the pattern control by using an infrared ray communication. On the other hand, the corresponding relationships between each switch and the relay controlling the load actually is established by mounting the setting device on the operation terminal, and connecting it to the transmission unit via the communication line. Accordingly, it is possible to perform a setting operation easily by performing two kinds of setting as one pair. Further, missing can be prevented by mounting the movable setting device on the operation terminal arranged on the wall side.

4 Claims, 8 Drawing Sheets

SETTING DEVICE OF CONTROL SYSTEM

This application claims benefit under 35 U.S.C. § 119 from Japanese Patent Application No. 2004-275423, filed on Sep. 22, 2004, the entire content of which is incorporated herein by reference.

BACKGROUND OF THE INVENTION

1. Field of the Invention

The present invention relates to a setting device which is suitably used in a system for controlling many load devices, for example, in an illumination control system.

2. Description of the Related Art

As a system for controlling many load devices such as the illumination control system, a control system is commercially used wherein a load control terminal including a relay for actually controlling a load device, and a plurality of the operation terminals such as a wall side switch are connected to a control unit via a communication line, and said control unit drives the load device through a corresponding load control terminal, or the plurality of load control terminals in response to the operations of each of the operation terminals, thereby various controls of the load device may be performed. For example, in the illumination control system, a separate control which enables each wall side switch to control turning on and off of one corresponding illumination device or a plurality of illumination devices, a group control which controls turning on and off of one corresponding illumination device or a plurality of illumination devices that are divided into a group per a group, and a pattern control which changes the lighting pattern according to the outside brightness can be performed by setting arbitrarily the corresponding relationships between each of the operation terminals and the load control terminals.

But, it is necessary to set a load device for a target of control such as a separate address of the separate control, a group number of the group control, and a pattern number of the pattern control into each of the operation terminals in order to realize various controls. On the other hand, it is necessary to set the corresponding relationships between each of the operation terminals and the load control terminals such as the load device corresponding to a group 1, and the load device corresponding to a pattern 1 into the control unit.

Therefore, conventionally, the setting device which is required for the setting operation is disclosed, In the Patent Reference 1, an integral setting device of a load control data which allows a load address setting, and a pattern/group setting to be performed easily and simultaneously is disclosed. Further, In the Patent Reference 2, a wireless switch is disclosed in which an addressable remote controller is formed as a shape which is same to the standardized plated so that it may be used as a general wall side switch.

(Patent Reference 1) Japanese Patent Laid-Open NO. 2000-115865

(Patent Reference 2) Japanese Patent Laid-Open NO. H04-233895

In all the previous technology, an infrared ray remote controller is used for setting the load devices into each of the operation terminals which are arranged on an arbitrary wall side. The Patent Reference 1 includes a function to set a pattern/a group as well as a function of an infrared ray remote controller by connecting to a control unit. But, the wire connection to the control unit is not described in detail, but it is judged that a terminal connection to a communication line drawn from the neighborhood of the operation terminal is established. Therefore, in the pattern/the group setting, there is a troublesome problem that a plate of the wall side must be removed and a communication line has to be drawn out. Further, if the setting is performed, there is a shortcoming that it is not possible to manage a remote controller which is not used in the outside places because of the change of the room or the change of the seasons, and thereby it is vulnerable to the missing.

In the Patent Reference 2, a remote controller is accommodated into a wall side, and is used as a wall side switch by mounting it on the wall side. But, in the Patent Reference 2, only the fact that a remote controller is accommodated into the wall side is described. On the other hand, in case of this setting device, in connection with the operation terminal which is arranged on an arbitrary wall side of the indoor room, since the control unit is arranged at a remote place such as a management room or an electricity-division room, there was a troublesome problem that the person had to go to the place in order to set the parameters with a remote controller.

SUMMARY OF THE INVENTION

It is the object of the present invention to provide a setting device of a control system which enable the setting operations to be performed easily, and can prevent the missing.

A setting device of a control system according to the present invention, which is used for a system in which a plurality of load control terminals and a plurality of operation terminals are connected to a control unit via a communication line, and said control unit drives the load through a corresponding load control terminal or the plurality of load control terminals in response to the operations of each of the operation terminals, and which sets a corresponding relationship between each of the operation terminals and the load control terminals, comprises: a body portion including a first setting means for setting a load device which is to be a target of control of the operation terminal by a communication using an infrared ray with regard to the operation terminals arranged on a wall side, and a second setting means for setting a corresponding relationship between each of the operation terminals which are connected to said control unit via said communication line, in which the load device which is the target of control is set by said first setting means, and a real load control terminal; and a reception unit including a connection means for connecting said body portion to said communication line under the mounting state of said body portion, and in which is arranged on said wall side along with at least some of said operation terminals, and in which said body portion is detachably accommodated.

According to the above structure, in the setting device for performing above-mentioned setting, wherein a plurality of load control terminals and a plurality of operation terminals are connected to a control unit via a communication line, and which is used for a system in which various kinds of illumination control such as a separate control, a group control, and an a pattern control can be realized since said control unit drives the load through a corresponding load control terminal, or the plurality of load control terminals in response to the operations of each of the operation terminals, and the corresponding relationships between each of the operation terminals, and the load control terminals are set arbitrarily, a body portion is composed of a first setting means for setting the load device which is a target of control such as a separate address of the separate control, a group number of the group control, and a pattern number of the pattern control for the operation terminal such as the switches arranged on the wall side, and a second setting means for setting a corresponding relationship between each of the operation terminals which are connected to said control unit via said communication line, and in which the load device which is the target of control is set by said first setting means, and a real load control terminal, and a reception unit in which said body portion is detachably accommodated is arranged on the wall side along with at least some of the operation terminals. Further, under the state that the body portion is separated from the reception unit, it sets the load devices which are the target of control to the operation terminal arranged on the arbitrary wall side such as an indoor room, or a management room as a format of an infrared ray remote controller by using the first setting means. Under the state that the body portion is mounted in the reception unit, it is connected to the communication line via a connection means of the reception unit, and sets the corresponding relationship between each of the operation terminals and the real load control terminal by the second setting means.

Therefore, the first setting means for setting the load devices which are the target of control to the operation terminal arranged on the arbitrary wall side as a format of an infrared ray remote controller, and the second setting means connected to the control unit via the communication line for setting the corresponding relationship between each of the operation terminals and the real load control terminal by the second setting means are formed integrally so that the setting operation may be executed easily. Further, it is possible to perform the setting of the control unit by the second setting means connected the communication line only by mounting the movable body portion on the reception unit. Further, when being not used, missing can be prevented by mounting the body portion on the reception unit.

Further, the setting device of a control system according to the present invention, wherein feeding is performed via said communication line from the control unit under the state that said body portion is mounted on said reception unit, and in the state that setting is not performed, a load state outputted from said control unit is displayed.

According to the above structure, if the body portion which is detachably mounted on the reception unit is mounted on the reception unit, feeding is always performed from the control unit via the communication line, and it is possible to prevent the embedded battery which is used for setting the operation terminal by using the first setting means which is separated from the reception unit from being wasted. Preferably, after setting the embedded battery as a secondary battery, charging may be performed under the state that it is mounted on the reception unit.

Accordingly, since when setting to the control unit by the second setting means, feeding is performed and under the non-setting state, the operation becomes possible, the load state provided from the control unit is displayed. Thereby, the operation terminal on which the setting device is arranged, for example, only displays ON/OFF state of the load device, and in the setting device, various control state can be displayed. For example, ON/OFF state of the load device is displayed sequentially by using the display unit mounted for the setting operation, or the number of devices of ON/OFF state is displayed.

Further, in the setting device of a control system according to the present invention, wherein a duplex communication can be performed by an infrared ray communication unit of said first setting means and said operation terminal, a contents which is already set can be read to the first setting means from the operation terminal before setting is performed, and in the body portion, an operation channel of the operation terminal is selected in response to input operation of an input means, and thereby, information of a load device of the channel is displayed on the display unit.

According to the above structure, contents which are already set can be read to the first setting means from the operation terminal by the duplex communication of the infrared ray before setting. For example, when a plurality of switches are connect or mounted, in a case that the operation terminals arranged on the wall side can set the load devices of a plurality of channels, the setting contents is displayed on the display unit of the body portion by selecting a channel by a selection manipulation of the input means.

Therefore, even if many load devices are set for one operation terminal, it is possible to display the setting contents of all channels in detail.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Certain embodiments of the present invention will be described in greater detail with reference to the accompanying drawings.

Figure 1:
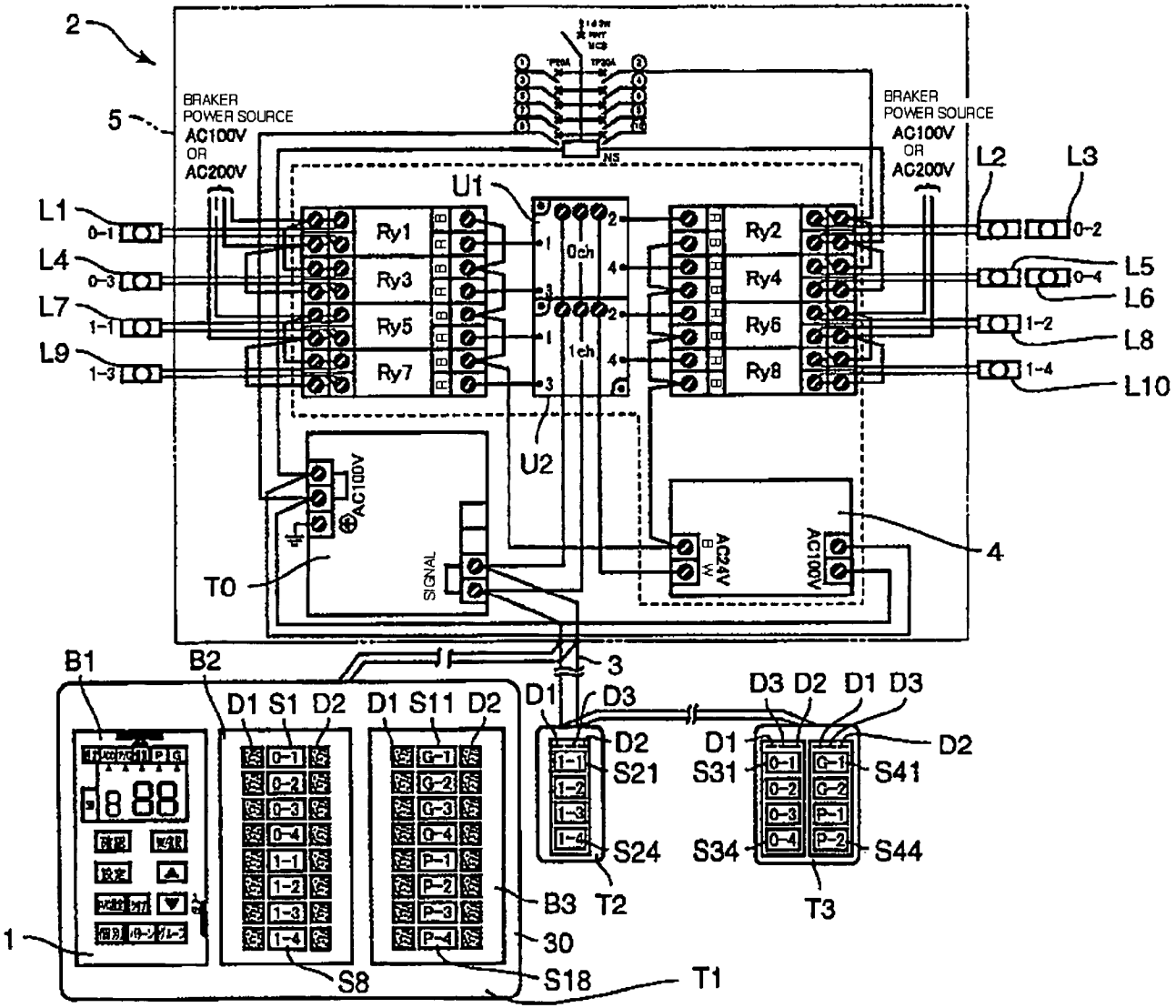
FIG. 1 is a block diagram showing an electrical structure of an illumination control system provided with a setting device according to the first embodiment of the present invention.
Figure 3:
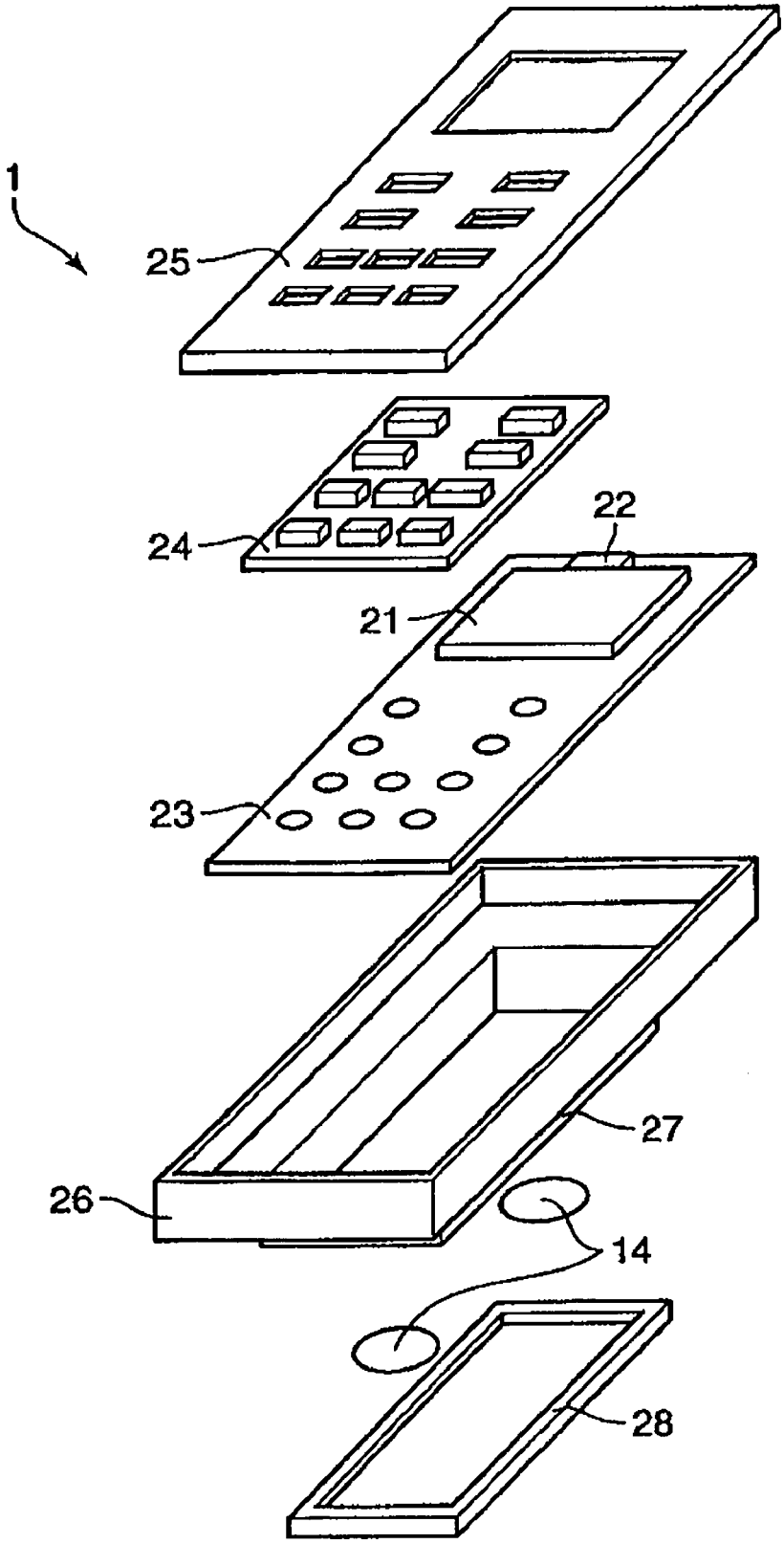
FIG. 3 is a view analytically showing the setting device of shown in FIG. 2.
Figure 8:
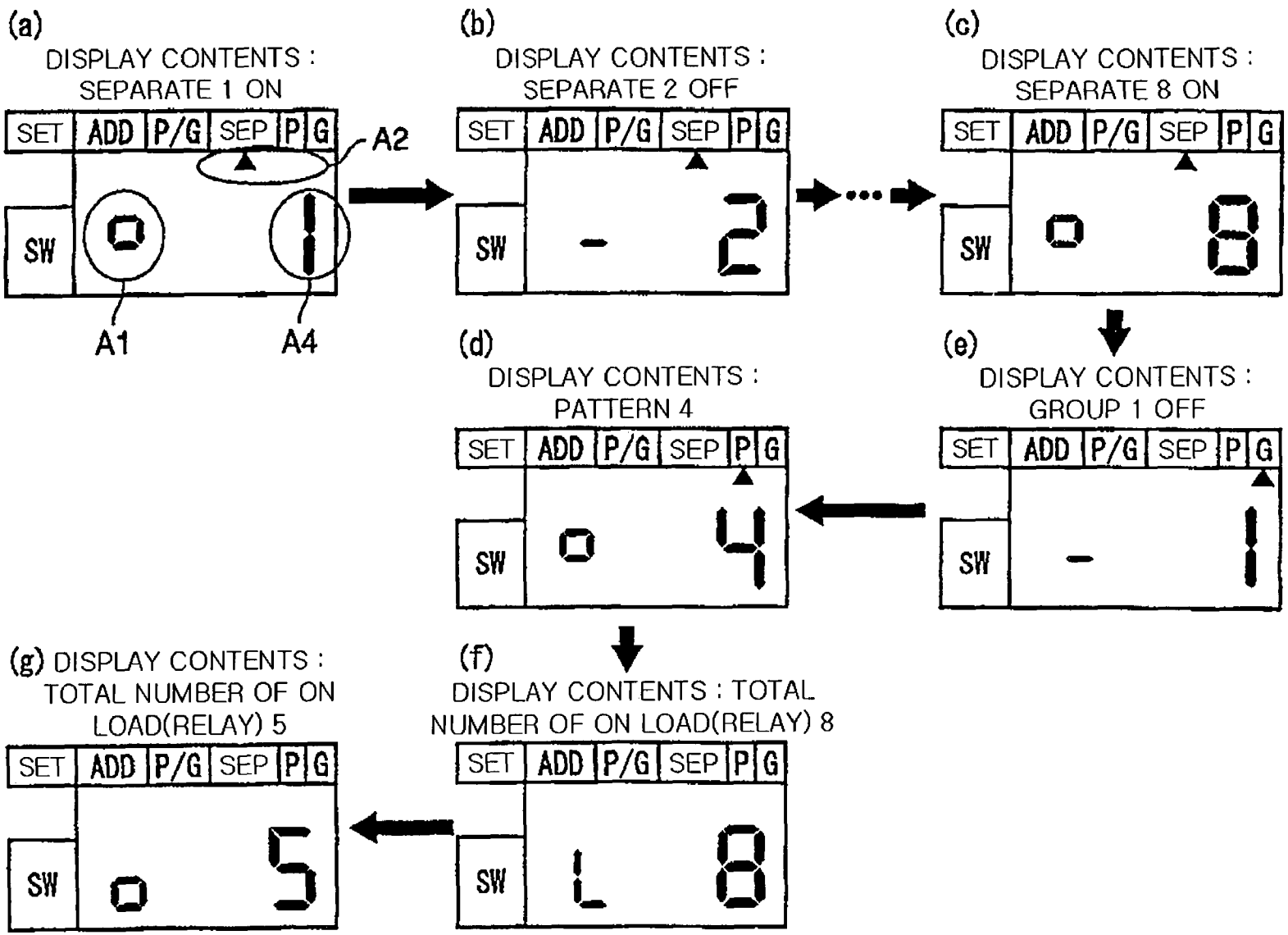
FIG. 8 is a view showing an example for displaying a load state by using a display unit of the setting device.

FIG. 1 is a block diagram showing an electrical structure of an illumination control system 2 provided with a setting device 1 according to the first embodiment of the present invention. In this illumination control system 2, generally, a terminal unit U1, U2 for controlling a plurality relays Ry1-Ry8 (8 channel is shown in FIG. 8), which are load control terminals, and a plurality of operation terminals T1-T3 (3 terminals are shown in FIG. 3) are connected to a transmission unit T0 which is a control device via a common communication line 3. In response to the operations of each operation terminal T1-T3, the transmission unit T0 drives an illumination device through a corresponding one relay or a plurality of relays. Various kinds of illumination control such as a separate control, a group control, and a pattern control can be realized by setting arbitrarily the corresponding relationships between the operation terminals T1-T3, and the relay Ry1-Ry8.

The operation terminals T1-T3 are arranged on the wall side of an indoor room, or a management office room. On the other hand, the transmission unit T0, the terminal unit U1, U2, the relay Ry1-Ry8 and a remote controller transformer 4 for providing a power for driving the relay Ry1-Ry8 are arranged in an electricity-division portion 5. Further, the communication line 3 formed by a pair of signal lines may be connected between each of the operation terminal T1-T3, the transmission unit T0, the terminal unit U1, U2, and the relay Ry1-Ry8. Each of the relays Ry1-Ry8 drives the illumination system L1-L10 by turning on/off the commercial AC outputted from a breaker in electricity-distribution portion 5. For example, a signal of ±24V is transmitted according to a communication format such as RS485 and so on, through the communication line 3.

The transmission unit T0 can identify a relay by using a 8 bit address, identify the terminal unit of 0-63 channel by using an upper 6 bit, and identify a load number (1-4) by using a lower 2 bit. In the example of FIG. 1, the terminal units are U1, and U2, and each of the relays (Ry1-Ry4; Ry1-Ry8) are connected to them. Accordingly, in the illumination control system 2 of the FIG. 1, a separate switch for a separate control corresponding to each load channel of 8 channels is required for the operation terminals T1-T3. If necessary, a group control switch, and a pattern control switch are arranged.

In the example of FIG. 1, the switch S1-S8 for the separate control, and the switch S11-S18 for a group/a pattern control are arranged on the operation terminal T1 (for the brevity of the drawings, some reference numbers are omitted.). For example, if the switch S1 is operated, the relay Ry1 of the load number 1 is controlled by the terminal unit U1 of the load channel 0, and ON/OFF of the illumination equipments of the load device address 0-1 is controlled. Likewise, the relay Ry2-Ry8 is controlled by the switch S2-S8, and the illumination equipments L2, L3, L4, L5, L6, L7, L8, L9, L10 of the load device address 0-2,0-3,0-4,1-1,1-2,1-3,1-4 are controlled, respectively.

Further, in the example if the FIG. 1, if the switch S11-S14 is operated, each group control is performed in the group G1-G4 which is formed by dividing arbitrarily each of the relay Ry1-Ry4 as a group. Likewise, if the switch S15-S18 is operated, a pattern control is performed for the relay Ry1-Ry4 according to the predetermined pattern P-1~P-4.

A LED (light emitting diode) D1 of a red color, a LED D2 of a green color are arranged on both sides of each of the switch S1-S8; S11-S18. When the corresponding switch is turned on, the LED D1 of a red color is lighted, and the LED D2 of a green color is not lighted. When the corresponding switch is turned off, the LED D2 of a green color is lighted, and thereby ON/OFF state is displayed. A LED D1 of a red color, a LED D2 of a green color are arranged on both sides of an upper part of the remaining switch S21-S24; S31-S34; S41-S44. A transmission/reception unit D3 using an infrared ray which is described later is arranged between the LED D1 and the LED D2 of the typical switch S21, S31, S41 of switch S21-S24; S31-S34; S41-S44.

In the operation terminal T2, the switch S21-S24 is arranged and the addresses 1-1~1-4 of the load devices corresponding to each of the relay Ry5-Ry8 of the terminal unit U2 are set. Further, in the operation terminal T3, the switch S31-S34, S41-S44 is arranged, and in connection with the switch S31-S34, the addresses 0-1~0-4 of the load devices corresponding to each of the relay Ry1-Ry4 of the terminal unit U1 are set. A group G-1, G-2, and a pattern P-1, P-2 are sequentially set in the switch S41-S44.

Therefore, the setting device 1 is used in order to set the addresses 0-1~0-4, 1-1~1-4 of the load devices, the group G-1~G-4, the pattern P-1~P-4. The setting operation will be described briefly. In the operation terminal T2, T3, a setting is performed by separating the setting device 1 from the operation terminal T1, and using it as a remote controller using an infrared ray. In the operation terminal T1, the setting is performed under the state that the setting device 1 is attached, and the corresponding relationships between the switches S1-S8, S11-S18, S21-S24, S31-S34, S41-S44, and the real relay Ry1-Ry8 are set.

On the other hand, in the terminal unit U1, U2, a load channel is set by a dip switch of 6 bits, and the load number of the relay Ry1-Ry4; Ry5-Ry8 is determined according to the terminal unit U1, U2 to which the relay is connected.

Figure 2:
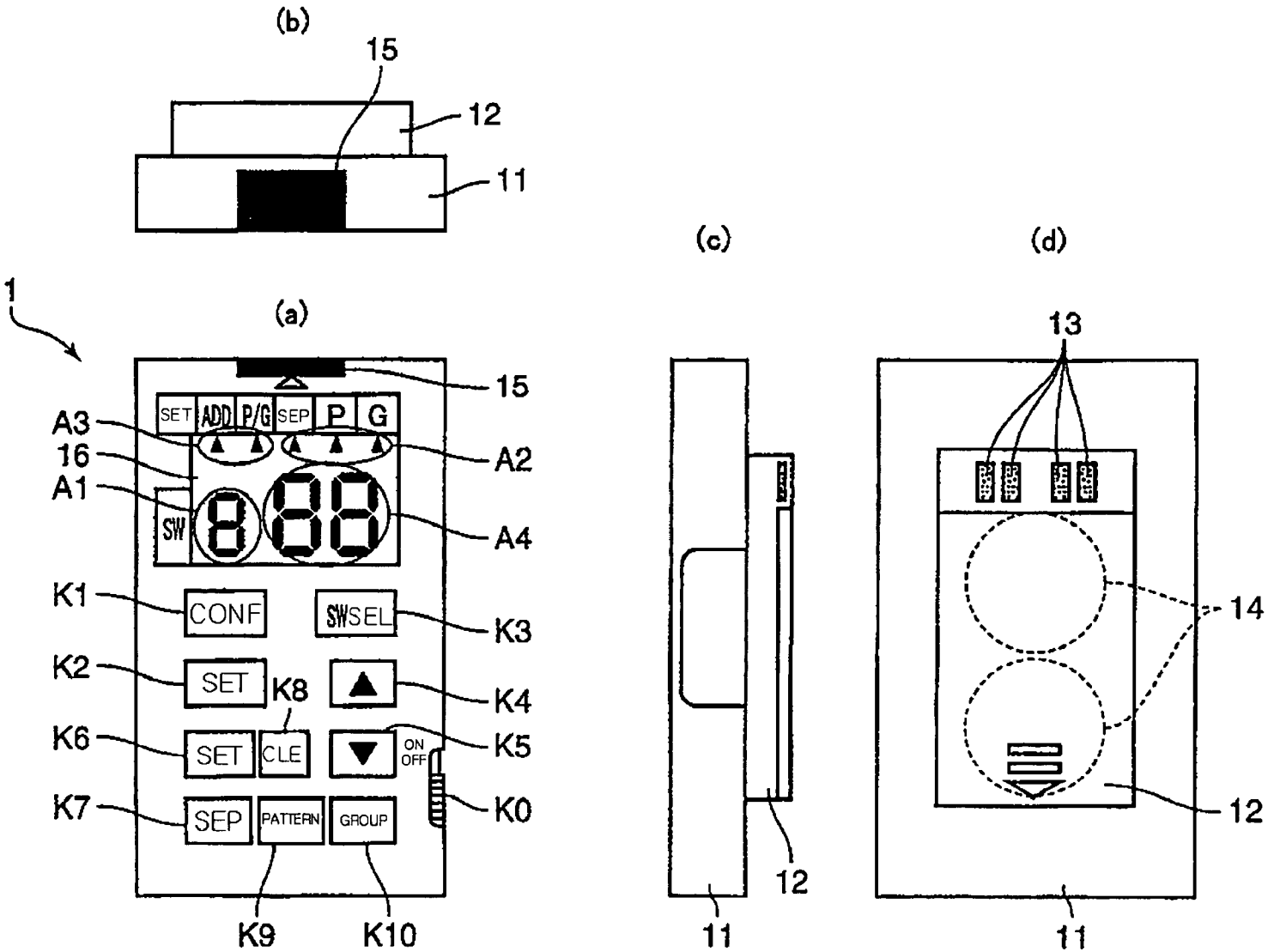
FIG. 2 is a view showing of the setting device an illumination control system of FIG. 1.

FIG. 2 is a view showing the setting device 1, and FIG. 2*a* is a front view, FIG. 2*b* is a view showing an upper surface side, FIG. 2*c* is a view showing a right side surface, and FIG. 2*d* is a view showing a rear side. Generally, in connection with the setting device 1, a battery reception unit 12 is formed on a body 11 of the plate shape so that it may be protruded. A contact point 13 is arranged in the rear side of the battery reception unit 12 for connecting to the communication line 3. In the battery reception unit 12, a battery 14 of a button shape is accommodated. On the upper side of the body 11, a transmission/reception unit 15 using an infrared ray is arranged, and a power switch K0 is arranged on the side surface. A display unit 16 and various kinds of the operation keys (K1-K10) are arranged.

FIG. 3 is a view analytically showing the setting device 1. The inner structure of the setting device 1 is composed of a liquid crystal panel 21 which is the display unit, an infrared ray module 22 which is the transmission/reception unit 15 using an infrared ray, a terminal which is the contact point 13, and the terminal of the battery 14. A rubber switch 24 which is the operation switch K1-K10 is stacked on the circuit board 23 on which a control circuit described later for the setting operation and an integrated circuit such as a memory are mounted. The above-mentioned elements are inserted between a front cover 25 and a back cover 26. The projection part of the back cover 26 is opened and after the battery is accommodated, it is closed by the battery cover.

Figure 4:
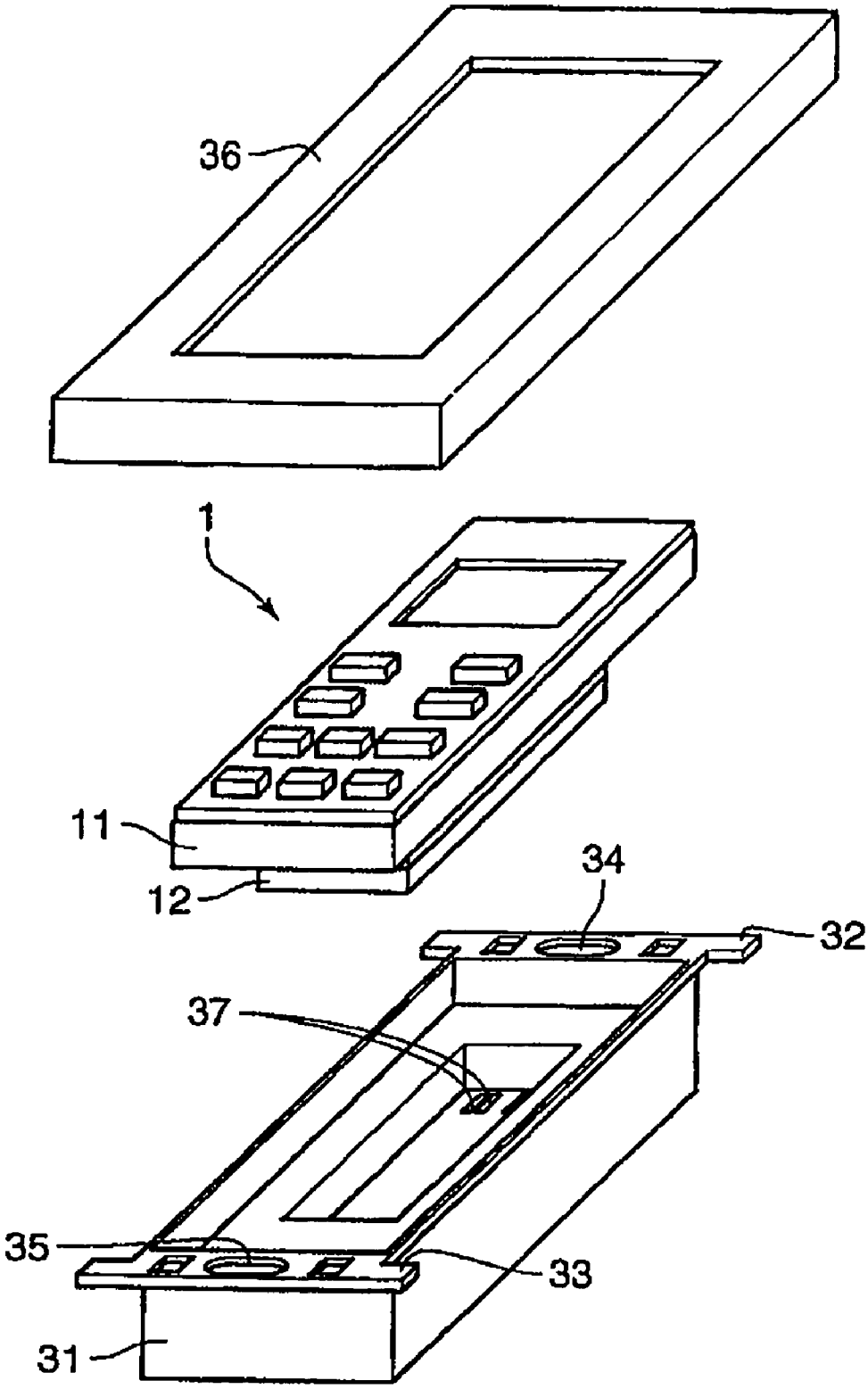
FIG. 4 is view analytically showing an attachment structure for attaching the setting device of shown in FIG. 2 to an operation terminal.

As is described above, FIG. 4 is a view showing the attachment structure for attaching the setting device 1 to an operation terminal T1. In the example of FIG. 1, the operation terminal T1 is formed as a series of 3 specified outlet block, and is composed of a block B1, a block B2 of the switch S1-S8, and a block of the switch S11-S18. An accessory plate 30 is inserted in the outer periphery. As is already known, a block B2, B3 for the switch S1-S8; S11-S18, is directly fixed to a box embedded into a wall.

Figure 5:
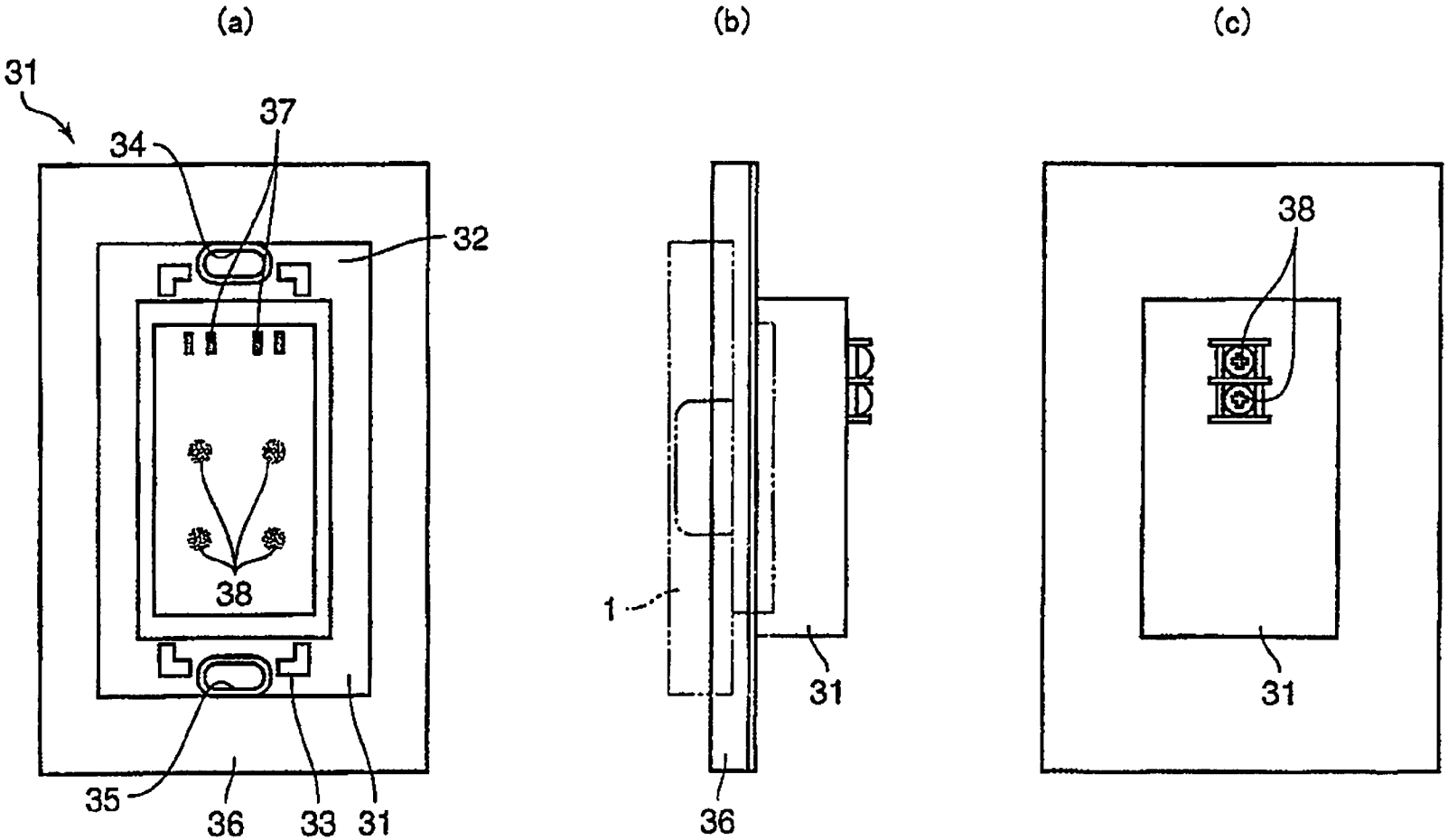
FIG. 5 is a view showing a base block for attaching the setting device to a wall side.

On the other hand, the setting device 1 is mounted on the base block 31 which functions as a terminal stand shown in FIG. 5. FIG. 5*a* is a front view of the base block 31, FIG. 5*b* is a view showing a right side, and FIG. 5*c* is a view showing a rear side. Generally, the base block 31 is formed as a boat shape, and a screw which is inserted into the screw holes 34, 35 of a flange formed on both ends in the longitudinal direction is connected to a screw hole formed on the box by a screw, and thereby is fixed to the box by a screw. The setting device is inserted into the base block 31, and is absorbed by a magnet 38. A plate 36 for preventing the falling-off is mounted on the front side. If the setting device 1 is mounted in the base block 31, the contact point 13 is electrically connected to the contact point 37 of the base block 31 side. The contact point 37 is electrically connected to the terminal stand 38 of the rear side, and wiring of the communication line 3 is sequentially arrayed along with same terminal stand arranged on the block B2, B3 which are attached in same box.

Figure 6:
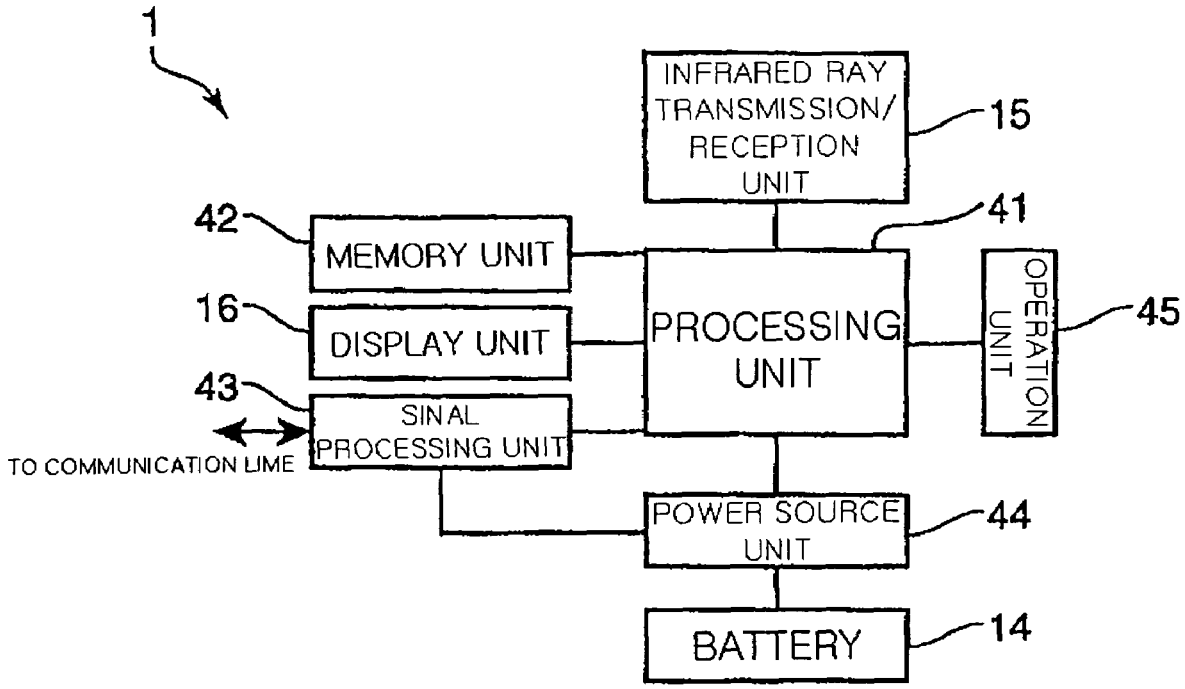
FIG. 6 is a block diagram showing an electrical structure of a setting device.

FIG. 6 is a block diagram showing an electrical structure of a setting device 1. The setting device 1 is formed by a microcomputer, and is composed of a processing unit 41 for performing a setting operation, a memory unit 42 for storing the operation program or a setting value, a signal processing unit 43 communicating with the transmission unit T0 or the block B2, B3 through the communication line 3, and a power source unit 44, the battery 14, the transmission/reception unit 15 using an infrared ray, an operation unit 45 including an operation key K1-K10 and the power switch K0, and the display unit 16. In the structure of the setting device 1 of FIG. 6, the remaining structure except the signal processing unit 43 forms a first setting means for performing a setting described later through communication using infrared rays. The remaining structure except the transmission/reception unit 15 using an infrared ray is connected to the transmission unit T0 through the communication line, and thereby forms a second setting means for performing a setting described later.

If the setting device is mounted on the base block 31, and thereby, conduction state is formed between the contact points 13, 37, AC of the communication line 3 is derived from the signal processing unit 43, rectified and stabilized, and supplied to each unit from the processing unit 41. Further, if the setting device 1 is separated from the base block 31, the power supplied from the battery 14 is provided to each unit from the processing unit 41. In a case that the current is fed through the communication line 3 under the state that the battery 14 is set as a secondary battery, is it possible to charge the battery 14.

Figure 7:
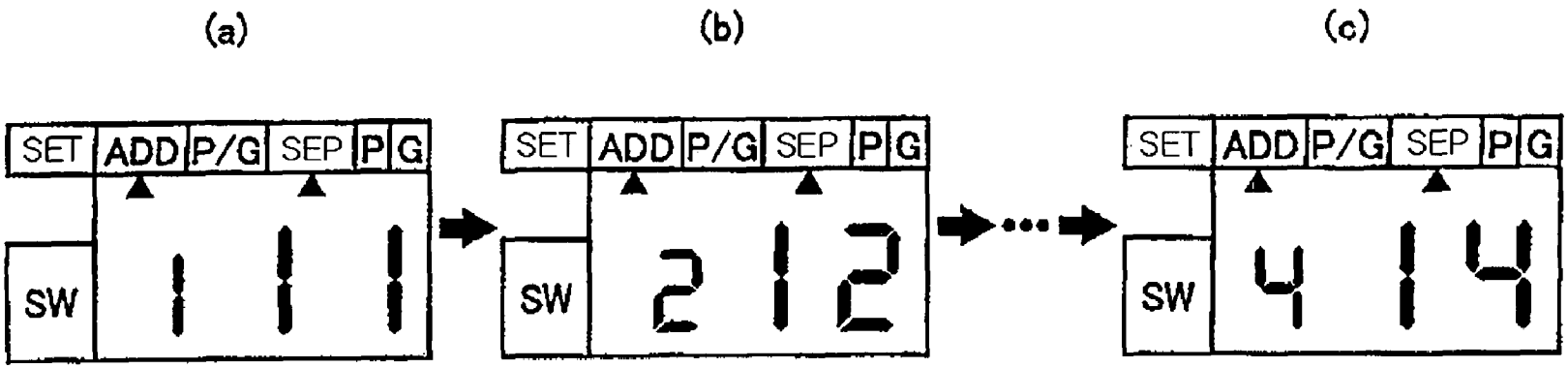
FIG. 7 is a view for explaining setting operations of a remote controller using infrared rays.

FIG. 7 is a view for explaining setting operations for the operation terminals T2, T3. Referring to FIG. 7, an example for setting a load device to a type of the operation terminal T2 will be explained. As is described above, in case of setting the operation terminal T2, T3, the setting device 1 is separated from the base block 31, and setting is performed by a remote controller using an infrared ray. The transmission/reception unit 15 using an infrared ray is positioned near to the transmission/reception unit D3 using an infrared ray 15 of the operation terminal T2 by turning on the power switch K0, and a duplex communication is performed by manipulating the confirmation key K1. The setting of the present state of the operation terminal (a block) comprising a series of switch S21-S24 is read. Especially, in case of construction, especially, if it is not necessary to confirm the setting contents of the present state, the confirmation task may be omitted.

Next, a switch selection key is manipulated while confirming a switch number display unit A1 of the display unit 16, and a switch which is a setting target is selected from the switch S21-S24 (In FIG. 7*a*, the switch S21 is selected.). Then, one of the setting of a separate address, the setting of a group number, and the setting of a pattern number is selected according to the operations of a separate key K7, a pattern key K9, and a group key 10 (in the operation terminal T2 of FIG. 1, a separate key K7 of a separate address) while confirming an operation mode display unit A3 or an addressing display unit A2. An address 1-1 of the load device which is to be set by an up key K4 or a down key K5 is set while confirming the separate key of the separate address, and the address number display unit A4. In case of setting the remaining switch S22-S24, first of all, the operation of the switch selection key K3 is repeated. Therefore, the address of the load device 1-2 of the switch S22 shown in FIG. 7*b*, and the address of the load device 1-4 of the switch S24 shown in FIG. 7*c* are set. In this way, if input of the setting is completed, as described above, the setting is practically performed by positioning the transmission/reception unit 15 using an infrared ray near to the transmission/reception unit D3 using an infrared ray of the operation terminal T2, and by manipulating the setting key K2. Then, the setting manipulation is completed.

In the setting manipulation of the operation terminal T1, first of all, setting of the load device number corresponding to the separate switch S1-S8, that is, the corresponding relays are performed. Each of the relays Ry1-Ry8 needs to be set as a separate switch, respectively. Setting for the separate switch (S1-S8) is not necessary as far as there are no changes in the load device number, that is, in the cases except a case of increase and decrease of the relay, and the terminal unit, or in a case of changing the connection between each relay and the terminal unit. Therefore, the setting is performed in case of construction. To be more specific, after a setting mode is set by manipulating the setting key K2, and a setting mode of a separate address is set by manipulating the separate key K7, as is described above, it may be possible to match a switch and an address of the load device which is to be set by the up key K4 or the down key K5 of the switch selection key K3, or it may be possible to set the address of the load device from the setting device 1 by manipulating the separate switch S1-S8 and then selecting. In the above-mentioned setting manipulation, the setting is performed under the condition that the setting device 1 is mounted on the base block 31, and communication is possible via the block B2, B3 and the communication line 3, but it may be possible to perform the setting by a remote controller using an infrared ray by arranging the transmission/reception unit D3 using an infrared ray in the above-mentioned block B2, B3.

Further, setting the corresponding relationships between each group/pattern, and the real relay Ry1-Ry8 is performed by using other block B2, B3 of the operation terminal T1 under the condition that the setting device is mounted on the base block 31, and it is possible to communicate with the transmission unit T0 via the communication line 3.

That is, the pattern/group selection key K6 is operated by turning on the power switch K0, and a pattern/group setting mode is set. If a pattern key K9, or a group key k10 is operated, one of the setting of a pattern/a group, or the setting of a pattern number is selected. Next, the group number or the pattern number which is set by the up key K4 or the down key K5 is selected. Then, a switch for performing a group setting or a pattern setting is selected by manipulating the switch S11-S18. Under the state, a corresponding switch of the switch S1-S8, that is, a relay is selected and the switch S11-S18, and the switch S1-S8 are matched by manipulating the setting switch K2. In short, the corresponding relationships between each group/pattern, and the real relay are set.

In this way, according to the setting device 1 of the present invention, a plurality of terminal units U1, U2, and a plurality of the operation terminals T1-T3 are connected to the transmission unit T0 via the communication line 3. In response to the operations of each of the operation terminal T1-T3, the transmission unit T0 drives the illumination device L1-L10 via a corresponding relay or a plurality of relays Ry1-Ry8. The setting device 1 is used in an illumination control system in which various kinds of illumination control such as a separate control, a group control, and an a pattern control can be implemented by setting the corresponding relationships arbitrarily between the plurality of relays Ry1-Ry8, and each of the operation terminal T1-T3. In the setting device performing the setting operation, a separate address of the separate control, a group number of the group control, and a pattern number of the pattern control.

A body 1 is composed of a first setting means for performing the setting by a communication using an infrared ray, each switch S1-S8; S11-S18; S21-S24; S31-S34; S41-S44 which is connected to the transmission unit T0 via the communication line 3, and to which an illumination device of a control target is set by the first setting means, and a second setting means for setting a corresponding relationships of the relay Ry1-Ry8 for substantially controlling the loads. On the body 11, the detachable base block 31 and the switch S1-S8; S11-S18 on the wall side are arranged in a parallel state. Further, the illumination device L1-L10 which is the control target is set to the operation terminal T2, T3 which is arranged on an arbitrary wall side such as an indoor room or a management room as a format of a remote controller using an infrared ray by the first setting means. Under the mounting state, the body 11 is connected to the communication line 3 via the terminal stand 38 from the contact point 37 of the base block. Therefore, corresponding relationships between each switch S1-S8; S11-S18; S21-S24; S31-S34; S41-S44, and the relay Ry1-Ry8 are set.

Accordingly, it becomes possible to perform the setting task by designing the first setting means for setting the illumination device L1-L10 of a control target to the operation terminals arranged on an arbitrary wall, and a second setting means which is connected to the transmission unit T0 via the communication line 3 for setting a corresponding relationships between the relay Ry1-Ry8 and each switch S1-S8; S11-S18; S21-S24; S31-S34; S41-S44 integrally. Further, the body 11 is connected to the communication line only by mounting the body 11 of a on the base block 31. Therefore, it becomes to be possible for the second setting means to perform the setting for the transmission unit T0. Further, when not using the body, the loss can be prevented by mounting the body 11 on the base block 31.

Further, in the infrared ray communication unit (15, D3) of the setting device 1 and the operation terminal T2, T3 can perform the duplex communication, and before setting, the contents which are already set can be read by the setting device 1, and in the display unit 16, the switch S21-S24; S31-S34; S41-S44 of the operation terminal T2, T3 is selected in response to the input manipulation of the operation unit 45, and the information of the load devices of the switch S21-S24; S31-S34; S41-S44 is displayed. Therefore, even if a plurality of switches is mounted, it is possible to display the setting contents of all switches in detail.

Under the setting device 1 is mounted on the base block 31, even when the operation manipulation is completed, if the power switch K0 is in "ON" state, the feeding is continuously performed from the transmission unit T0 via the communication line 3, and the load state obtained from the transmission unit T0 is displayed in the display unit 16.

For example, FIG. 8*a* shows a state of a switch S1, and a separate control is displayed on the address display unit A2. An address [1] of the separate control is displayed on an address number display unit A4, and [o] representing the lighting state is displayed on a switch number display unit A1. Further, under the state of the switch S2 of FIG. 8*b*, a separate control is displayed on the address display unit A2. An address [2] of the separate control is displayed on an address number display unit A4, and [–] representing the blackout state is displayed on a switch number display unit A1. Further, FIG. 8*c* shows a state of a switch S8, and a separate control is displayed on the address display unit A2. An address [8] of the separate control is displayed on an address number display unit A4, and [○] representing the lighting state is displayed on a switch number display unit A1.

FIG. 8*d* shows a state of a switch S11, and a group control is displayed on the address display unit A2. A group number [1] is displayed on an address number display unit A4, and [–] representing the turning on or off states is displayed on a switch number display unit A1. FIG. 8*e* shows a state of a switch S18, and a pattern control is displayed on the address display unit A2. A pattern number [4] is displayed on an address number display unit A4, and [○] representing the lighting state is displayed on a switch number display unit A1.

In FIG. 8*f*, since display of the address display unit A2 is not performed, the switch content is not displayed. [L] representing total load (relay) is displayed on a switch number display unit A1, and a total load (relay) [8] is displayed on an address number display unit A4. Likewise, in FIG. 8*g*, the switch contents is not displayed, but [○] representing total load (relay) of ON state is displayed on a switch number display unit A1, and the number of load (relay) [5] is displayed on an address number display unit A4.

In this way, even if the operation terminal T1 provided with the setting device displays only ON/OFF of the switch S1-S8, S11-S18 by using the LED D1, D2, it is possible to display various kinds of the control state on the setting device 1. In connection with the display of FIG. 8*a*-FIG. 8*g*, an automatic change may be made at every pre-set time, or the operations may performed be by manipulation of an up key K4 or a down key K5

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A setting device of a control system which is used for a system in which a plurality of load control terminals and a plurality of operation terminals are connected to a control unit via a communication line, and said control unit drives the load through a corresponding load control terminal or the plurality of load control terminals in response to the operations of each of the operation terminals, and which sets a corresponding relationship between each of the operation terminals and the load control terminals, the setting device comprising:

a body portion including a first setting means for setting a load device to perform required control contents, and the load device is to be a target of control of the operation terminal by a communication using an infrared ray with regard to the operation terminals arranged on a wall side, and a second setting means for setting a corresponding relationship between each of the operation terminals which are connected to said control unit via said communication line, in which the load device which is the target of control is set by said first setting means, and a real load control terminal; and a reception unit including a connection means for connecting said body portion to said communication line under the mounting state of said body portion, and in which is arranged on said wall side along with at least some of said operation terminals, and in which said body portion is detachably accommodated.

2. The setting device of a control system of claim 1, wherein feeding is performed via said communication line from the control unit under the state that said body portion is mounted on said reception unit, and in the state that setting is not performed, a load state outputted from said control unit is displayed.

3. The setting device of a control system of claim 1, wherein a duplex communication is performed by an infrared ray communication unit of said first setting means and said operation terminal, a contents which is already set is read to the first setting means from the operation terminal before setting is performed, and in the body portion, an operation channel of the operation terminal is selected in response to input operation of an input means, and thereby, information of a load device of the channel is displayed on the display unit.

4. The setting device of a control system of claim 2, wherein a duplex communication is performed by an infrared ray communication unit of said first setting means and said operation terminal, a contents which is already set is read to the first setting means from the operation terminal before setting is performed, and in the body portion, an operation channel of the operation terminal is selected in response to input operation of an input means, and thereby, information of a load device of the channel is displayed on the display unit.

* * * * *